United States Patent [19]

Bernard et al.

[11] 4,167,000

[45] Sep. 4, 1979

[54] MEASURING-WHILE DRILLING SYSTEM AND METHOD HAVING ENCODER WITH FEEDBACK COMPENSATION

[75] Inventors: James I. Bernard, Houston; Gerald A. Strom, Dayton, both of Tex.

[73] Assignee: Schlumberger Technology Corporation, New York, N.Y.

[21] Appl. No.: 898,721

[22] Filed: Apr. 24, 1978

Related U.S. Application Data

[63] Continuation of Ser. No. 727,685, Sep. 29, 1976, abandoned.

[51] Int. Cl.[2] ..... G01V 1/40

[52] U.S. Cl. ..... 367/84

[58] Field of Search ..... 340/18 NC, 18 LD, 18 FM; 318/314

[56] References Cited

U.S. PATENT DOCUMENTS

| | | | |
|---|---|---|---|
| 3,176,208 | 3/1965 | Gifft | 318/314 |
| 3,331,006 | 7/1967 | Strand et al. | 318/318 |
| 3,789,355 | 1/1974 | Patton | 340/18 LD |
| 3,820,063 | 6/1974 | Sexton et al. | 340/18 LD |
| 3,821,696 | 4/1974 | Harrell et al. | 340/18 LD |
| 3,828,234 | 8/1974 | Goldberg | 318/314 |
| 3,930,220 | 12/1975 | Shawhan | 340/18 FM |
| 3,950,682 | 4/1976 | Dohanick, Jr. | 318/314 |
| 3,974,428 | 8/1976 | Hafle | 318/314 |

*Primary Examiner*—Howard A. Birmiel

*Attorney, Agent, or Firm*—David L. Moseley; William R. Sherman; Wayne M. Harding

[57] ABSTRACT

A measuring-while-drilling system having a downhole, motor-driven acoustic signal generator includes a motor speed control circuit featuring feedback compensation which accounts for varying loading conditions on the motor. The acoustic signal generator is motor driven at speeds for imparting to well fluid an acoustic signal having phase states representative of data derived from measured downhole conditions. The motor control circuit includes circuitry which forms a phase locked loop for driving the motor at a reference phase and at a substantially constant carrier frequency producing speed in the absence of data of one logic state and also includes circuitry for temporarily changing the speed of the motor, according to a pre-programmed function, to effect a predetermined amount of phase change in the carrier signal upon data of the predetermined logic state. Upon occurrence of the data, the motor control circuit takes control away from the phase locked loop and changes the speed of the motor from the carrier frequency producing speed for accumulating a prescribed portion of the predetermined amount of phase change. To accumulate the remainder of the predetermined amount, it then returns the speed of the motor to the carrier frequency producing speed at which time it returns control of the motor to the phase locked loop. During operation feedback from the motor is provided to update the value of the prescribed amount according to loading conditions on the motor. This minimizes the time period required for the phase locked loop circuit to precisely establish the predetermined amount of phase change in the acoustic signal at the carrier frequency.

39 Claims, 5 Drawing Figures

142 MOTOR FREQUENCY DETECTOR
144
145
146
147
148
149
152
160
162
164
166
168
170
172
174
176
180
182
184
186
187
188
TS
TPA
WM
24 KHz REF.
ENABLE
MFD
U/D
PE
P0
P1
P2
P3
CO
CI
C
D
S
R
Q̄
X
X̄
Y
Ȳ
Z
Z̄
0
1

MEASURING-WHILE DRILLING SYSTEM AND METHOD HAVING ENCODER WITH FEEDBACK COMPENSATION

This is a continuation of application, Ser. No. 727,685, filed Sept. 29, 1976 now abandoned.

CROSS REFERENCE TO RELATED APPLICATIONS

This application contains subject matter related to U.S. Pat. No. 4,100,528, entitled Measuring-While-Drilling System and Method Having a Digital Motor Control and U.S. Pat. No. 4,103,281 entitled Measuring-While-Drilling System Having Motor Speed Detection During Encoding, both filed Sept. 29, 1976 and assigned to the assignee of this application.

BACKGROUND OF THE INVENTION

This invention relates to data measuring of downhole conditions within wells during drilling and more particularly relates to apparatus and methods for telemetering data in such operations using an acoustic signal transmitted through the drilling fluid during drilling.

Various logging-while-drilling techniques for telemetering data representing downhole conditions during drilling of a well have been suggested. One approach uses a technique which imparts an acoustic signal, modulated according to the sensed conditions, to the drilling fluid, i.e., the drilling mud, for transmission to the entrance of the well where it is received and decoded by uphole electronics circuitry. This basic technique is described in detail in U.S. Pat. No. 3,309,656, issued Mar. 14, 1967 to Godbey entitled "Logging-While-Drilling System." In this system the modulated signal is applied to the drilling fluid using an acoustic signal generator which includes a movable member for selectively interrupting the drilling fluid. At least part of the flow of the drilling fluid is through the acoustic generator, and the movable member selectively impedes this flow, transmitting a continuous acoustic wave uphole within the drilling fluid.

The acoustic signal is preferably phase shift keyed modulated, as disclosed in U.S. Pat. No. 3,789,355, issued Jan. 29, 1974, to Patton entitled "Method and Apparatus For Logging While Drilling." According to phase shift keyed (PSK) modulation, the data derived in response to the sensed downhole condition is initially encoded into binary format, and the acoustic signal generator is driven at speeds so that the phase of a constant frequency carrier wave generated in the drilling fluid is indicative of the data. In particular, a non-return to zero type PSK mode is used wherein the phase of the carrier signal is changed only upon each receipt of data of a predetermined value. For example, for data encoded in binary, the phase of the carrier wave may be changed for each occurrence of a logic 1 data bit.

Ideally the phase change of the carrier signal would be instantaneous upon occurrence of the data of the particular value. This is because the downhole telemetering unit is continuously transmitting data to the uphole receiving instruments where the data in turn is continuously decoded. Any delays in effecting the phase change and in returning the acoustic signal to its carrier frequency introduce errors and/or inefficiencies into the system.

As a practical matter, however, the phase of the acoustic signal cannot be changed instantaneously in response to data of the predetermined value. Inherent delays are introduced by the physics of the system. The motor control circuitry which operates the motor-driven acoustic generator is adjusted accordingly to effect optimum response of the generator. Past proposals, such as the above-referenced Godbey and Patton patent, and in U.S. Pat. No. 3,820,063, issued June 25, 1974, to Sexton et al. entitled "Logging While Drilling Encoder," have proposed several circuits for implementing the motor control circuitry. In the Patton and Sexton et al. patents, the speed of the motor was to be temporarily varied such that, upon returning of the motor speed back to the carrier frequency producing speed, the desired amount of phase change would be accumulated. In the Sexton et al. patent, this was accomplished by varying the speed of the motor in a first direction until a predetermined amount of phase shift had been accumulated. The motor speed was then returned in the other direction to the carrier frequency producing speed for a predetermined duration of time, thereby attempting to accumulate the remainder of the desired amount of the phase change.

The above proposals failed to recognize the problems associated with changes in the enviromental operating conditions of the logging-while-drilling system. For example, changes in the loading on the acoustic generator drive motor caused by changes in the pressure or the flow rate or the viscosity or density of the drilling fluid varies the length of time needed to return the motor speed back to the carrier frequency producing speed. This time variance varies the amount of phase accumulated during the return to the carrier frequency producing speed, causing a longer period of time to be needed in generating the proper amount of phase change at the carrier frequency. This longer period of time allows the introduction of inaccuracies into the system and/or decreases the rate of data transmission which otherwise would be obtainable.

SUMMARY OF THE INVENTION

The above noted and other shortcomings are overcome by the present invention by providing a measuring-while-drilling system having a motor speed control circuit for the motor driven acoustic generator which features motor feedback compensation during signal modulation. The system is thusly responsive to changing downhole conditions which affect the motor speed response time during phase changes. By compensating for changes in the motor loading, completion of a preprogrammed motor speed change for modulating the acoustic signal more nearly accumulates the precise amount of the total phase change desired. This minimizes the period required for re-establishing the proper phase and frequency characteristics in the acoustic signal, thereby minimizing the introduction of errors and optimizing the rate at which data can be modulated in the drilling fluid.

According to the invention, a measuring-while-drilling system includes a motor which is excited to drive an acoustic generator having a moveable member disposed for selectively interrupting the well fluid. The generator is driven at speeds for imparting to the well fluid an acoustic signal having modulated phase states representative of data derived from measured downhole conditions. This system further includes a motor control circuit having circuitry: (1) for driving the motor at a substantially constant speed to provide and maintain a carrier frequency and reference phase in the acoustic signal, and (2) for temporarily changing the speed of the motor to effect a predetermined amount of phase change in the carrier signal according to the downhole derived data. The frequency and phase maintaining circuitry preferably comprises a phase locked loop, and upon occurrence of the data, motor speed control is taken away from the phase locked loop circuitry. Control is then given to the speed changing circuitry, and the speed of the motor is temporarily changed from the constant frequency producing speed to a different speed value. When a prescribed portion of the predetermined amount is accumulated acording to a preprogrammed function, the speed of the motor is then returned to the carrier frequency producing speed, and control is returned to the frequency and phase maintaining circuitry. As an important feature of the invention, the precise value of the prescribed portion is updated using feedback from the motor so that the remainder of the predetermined amount is more nearly achieved during the return of the speed of the motor to the carrier frequency producing speed regardless of loading changes on the motor.

The motor control circuit includes a differential integrating circuit which generates a control signal indicative of the accumulation of the prescribed portion of the total phase change. The control signal initiates the return to the carrier frequency producing speed and is generated when a predetermined value is exceeded by the difference between (1) an integrated carrier frequency signal representing the value of the constant carrier frequency integrated over a time period beginning substantially upon the occurrence of one data signal and (2) an integrated drive frequency signal representative of the value of the instantaneous speed of the generator integrated over the time period. According to an aspect of the invention the differential integrating circuit includes a presettable accumulator circuit having programming inputs for updating the predetermined value in response to targeting compensation signal.

To provide the updating, the motor control circuit features a targeting compensation circuit for compensating for motor loading conditions which otherwise would allow the introduction of errors into the overall encoding process. The targeting compensation circuit is coupled to the motor for generating the targeting compensation signal in response to the drive frequency signal and thus to the loading of the motor.

The targeting compensation circuit includes a first signal generator for presetting the accumulator circuit of the differential integrating circuit to an estimated value corresponding generally to the value of the prescribed portion of the phase change. A correction signal generator is also provided for adjusting the estimated value as a function of the amount of phase change provided to the acoustic signals during a previous data encoding.

According to a preferred embodiment, the correction signal generator generates the correction signal in response to the difference between the integrated drive frequency signal and the integrated carrier frequency signal upon a preselected condition of the acoustic signal. This preselected condition is, in the preferred embodiment, the occurrence of the frequency of the acoustic signal being returned to the carrier frequency after accumulation of the prescribed portion of phase change. This condition corresponds to the return of the speed of the motor from the different speed value to approximately the carrier frequency producing speed.

According to another aspect of the invention, the different speed value is a lower speed value, and the motor control circuit maintains the speed of the motor at this lower value until the prescribed portion of the predetermined phase change is accumulated. Upon generation of the control signal, the control circuit accelerates the speed of the motor back to the carrier frequency producing speed. The duration of the time interval during which the speed of the motor is at the lower value is accordingly a function of loading conditions on the motor because of the updating of the value of the prescribed portion as a function of the loading.

Accordingly, it is a general object of the present invention to provide a new and improved apparatus and method for telemetering downhole, well-drilling data during drilling which features motor loading compensation to the motor driven acoustic signal generator.

BRIEF DESCRIPTION OF THE DRAWINGS

The above and other features and advantages of the present invention will become more apparent in view of the following description of a preferred embodiment when read in conjunction with the drawings, wherein.

DESCRIPTION OF A PREFERRED EMBODIMENT

Figure 1:
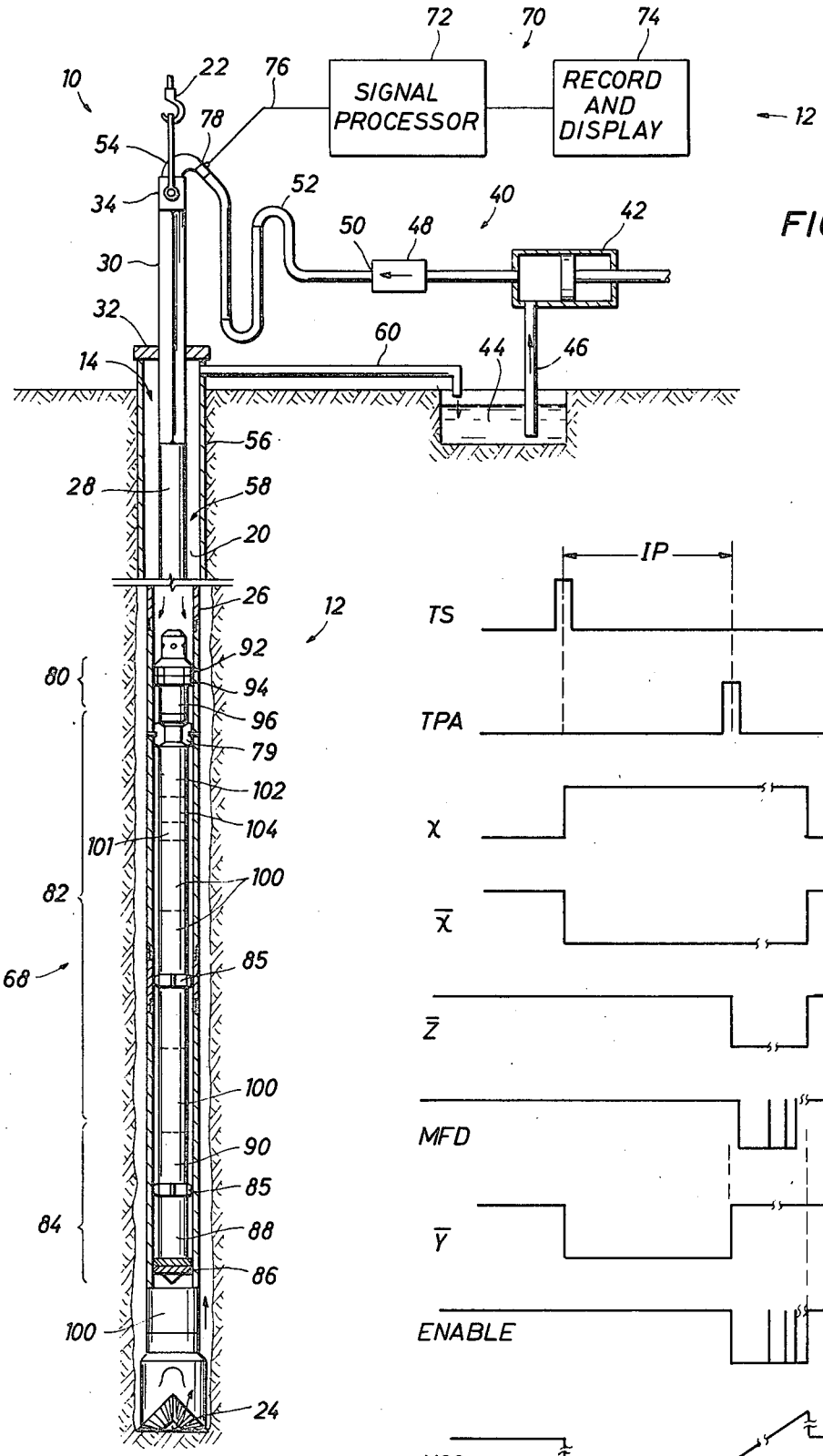
FIG. 1 is a schematic drawing showing a general well drilling and data measuring system according to the invention.

Referring now to the drawings, FIG. 1 shows a well drilling system 10 in association with a measuring-while-drilling system 12 embodying the invention. For convenience, FIG. 1 depicts a land based drilling system, but it is understood that a sea based system is also contemplated.

As the drilling system 10 drills a well-defining borehole 14, the measuring-while-drilling system 12 senses downhole conditions within the well and generates an acoustic signal which is modulated according to data generated to represent the downhole conditions. The acoustic signal is imparted to drilling fluid, commonly referred to as drilling mud, in which the signal is communicated to the surface of the borehole 14. At or near the surface of the borehole 14 the acoustic signal is detected and processed to provide recordable data representative of the downhole conditions. This basic system is now well-known and is described in detail in the above referred U.S. Pat. No. 3,309,656 to Godbey which is hereby incorporated by reference.

The drilling system 10 is conventional and includes a drill string 20 and a supporting derrick (not shown) represented by a hook 22 which supports the drill spring 20 within the borehole 14.

The drill spring 20 includes a bit 24, one or more drill collars 26, and a length of drill pipe 28 extending into the hole. The pipe 28 is coupled to a kelly 30 which extends through a rotary drive mechanism 32. Actuation of the rotary drive mechanism 32 (by equipment not shown) rotates the kelly 30 which in turn rotates the drill pipe 28 and the bit 24. The kelly 30 is supported by the hook via a swivel 34.

Positioned near the entrance to the borehole 14 is a conventional drilling fluid circulating system 40 which circulates drilling fluid, commonly referred to as mud, downwardly into the borehole 14. The mud is circulated downwardly through the drill pipe 28 during drilling, exits through jets in the bit 24 into the annulus and returns uphole where it is received by the system 40. The circulating system 40 includes a mud pump 42 coupled to receive the mud from a mud pit 44 via a length of tubing 46. A desurger 48 is coupled to the exit end of the mud pump 42 for removing any surges in the flow of the mud from the pump 42, thereby supplying a continuous flow of mud as its output orifice 50. A mud line 52 couples the output orifice 50 of the desurger to the kelly 30 via a gooseneck 54 coupled to the swivel 34.

Mud returning from downhole exits near the mouth of the borehole 14 from an aperture in a casing 56 which provides a flow passage 58 between the walls of the borehole 14 and the drill pipe 28. A mud return line 60 transfers the returning mud from the aperture in the casing 56 into the mud pit 44 for recirculation.

The measuring-while-drilling system 12 includes a downhole acoustic signal generating unit 68 and an uphole data receiving and decoding system 70. The acoustic signal generating unit 68 senses the downhole conditions and imparts a modulated acoustic signal to the drilling fluid. The acoustic signal is transmitted by the drilling fluid to the uphole receiving and decoding system 70 for processing and display.

To this end, the receiving and decoding system 70 includes a signal processor 72 and a record and display unit 74. The processor 72 is coupled by a line 76 and a pressure transducer 78 to the mud lines 52. The modulated acoustic signal transmitted uphole by the drilling fluid is monitored by the transducer 78, which in turn generates electrical signals to the processor 72. These electrical signals are decoded into meaningful information representative of the downhole conditions, and the decoded information is recorded and displayed by the unit 74.

One such uphole data receiving and decoding system 70 is described in U.S. Pat. No. 3,886,495 to Sexton et al., issued May 27, 1975, entitled "Uphole Receiver For Logging-While-Drilling System," which is hereby incorporated by reference.

The downhole acoustic signal generating unit 68 is supported within one of the dowhole drill collars 26 by a suspension mechanism 79 and generally includes a modulator 80 having at least part of the flow of the mud passing through it. The modulator 80 is controllably driven for selectively interrupting the flow of the drilling fluid to thereby impart the acoustic signal to the mud. A cartridge 82 is provided for sensing the various downhole conditions and for driving the modulator 80 accordingly. The generating unit 68 also includes a power supply 84 for energizing the cartridge 82. A plurality of centralizers 85 are provided to position the modulator 80, the cartridge 82, and the supply 84 centrally within the collar 26.

The power supply 84 is now well-known in the art and includes a turbine 86 positioned within the flow of the drilling fluid to drive the rotor of an alternator 88. A voltage regulator 90 regulates the output voltage of the alternator 88 to a proper value for use by the cartridge 82.

The modulator 80 is also now well-known in the art. It includes a movable member in the form of a rotor 92 which is rotatably mounted on a stator 94. At least part of the flow of the mud passes through apertures in the rotor 92 and in the stator 94, and rotation of the rotor selectively interrupts flow of the drilling fluid when the apertures are in misalignment, thereby imparting the acoustic signal to the drilling fluid. The rotor 92 is coupled to gear reduction drive linkage 96 which drives the rotor. The cartridge 82 is operably connected to the linkage 96 for rotating the rotor 92 at speeds producing an acoustic signal in the drilling fluid having (1) a substantially constant carrier frequency which defines a reference phase value, and (2) a selectively produced phase shift relative to the reference phase value at the carrier frequency. The phase shift is indicative of encoded data values representing the measured downhole conditions.

In the preferred embodiment the drive linkage 96 and the designs of the rotor 92 and stator 94 are chosen to generate 1/5 of a carrier cycle in the acoustic signal for each revolution of the motor 102.

A suitable modulator 80 is shown and described in detail in U.S. Pat. No. 3,764,970 to Manning which is assigned to the assignee of this invention. Other suitable modulators 80 are described in the above-referenced Patton and Godbey patents, as well as in "Logging-While-Drilling Tool" by Patton et al., U.S. Pat. No. 3,792,429, issued Feb. 12, 1974, and in "Logging-While-Drilling Tool" by Sexton et al., U.S. Pat. No. 3,770,006, issued Nov. 6, 1973, all of which are hereby incorporated by reference.

Referring now to the cartridge 82, it includes one or more sensors 100 and associated data encoding circuitry 101 for measuring the downhole conditions and generating encoded data signals representative thereof. For example, the sensors 100 may be provided for monitoring drilling parameters such as the direction of the hole (azimuth of hole deviation), weight on bit, torque, etc. The sensors 100 may be provided for monitoring safety parameters, such as for detecting over pressure zones (resistivity measurements) and fluid entry characteristics by measuring the temperature of the drilling mud within the annulus 58. Additionally, radiation sensors may be provided, such as gamma ray sensitive sensors for discriminating between shale and sand and for depth correlation.

The data encoding circuitry 101 is conventional and includes a multiplex arrangement for encoding the signals from the sensors into binary and then serially transmitting them over a data line. A suitable multiplex encoder arrangement is disclosed in detail in the above referenced Sexton et al. patent, U.S. Pat. No. 3,820,063, which is hereby incorporated by reference. The cartridge 82 also includes a motor 102 coupled to the linkage 96, and motor control circuitry 104 for controlling the speed of the motor 102 for rotating the rotor 92 of the modulator 80 at the proper speeds to effect the desired acoustic signal modulation. The motor 102 is a conventional two-phase AC induction motor which, in the preferred embodiment, is driven at 60 Hz by the motor control circuitry 102. Use of an induction motor for the motor 102 is not critical, as other types of motors, such as d.c. servomotor, are suitable.

Figure 2:
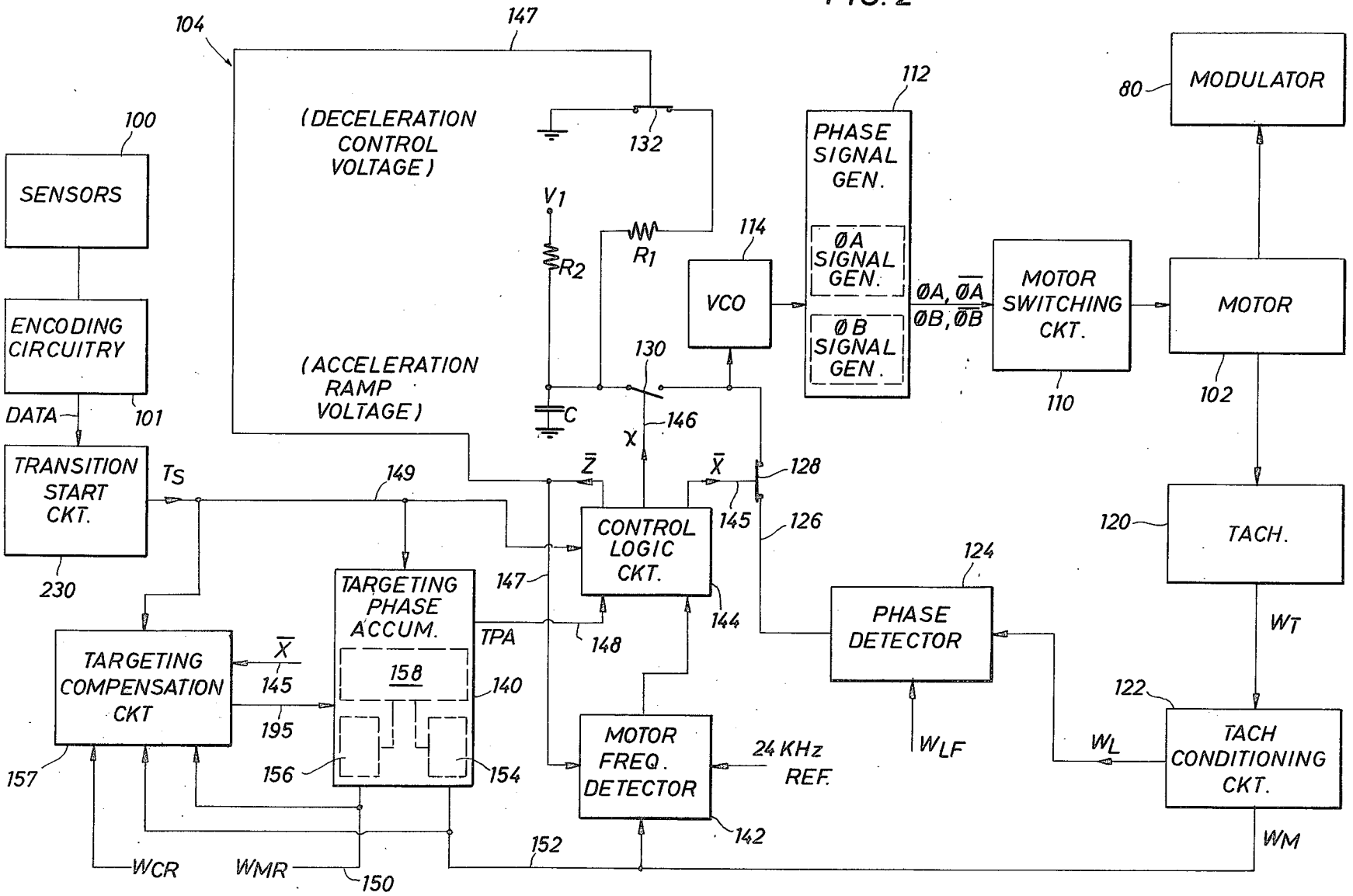
FIG. 2 is a block diagram of downhole telemetering apparatus utilized in the system of FIG. 1.

The motor control circuitry 104 is shown in relation to the motor 102, to the sensors 100 and encoding circuitry 101 and to the modulator 80 in FIG. 2. The motor control circuitry 104 includes circuitry (1) for maintaining the substantially constant carrier frequency of the acoustic signal transmitted in the drilling mud at the proper phase and (2) for changing the frequency of the acoustic signal and returning it to the carrier frequency to thereby change the phase thereof by a predetermined value as rapidly as possible in response to the encoded data. In the preferred embodiments wherein the data from the sensors 100 is encoded in binary, the phase change is one of 180 degrees.

The motor control circuitry 104 includes a motor switching circuit 110, such as a conventional dc-ac inverter, for supplying two-phase power to the two-phase motor 102.

A phase signal generator 112 and a voltage controlled oscillator (VCO) circuit 114 are provided to generate to the motor switching circuit 110 a pair of phase signals $\phi A$, $\phi B$ and their complements $\phi A$, $\phi B$. The phase signals are 90 degrees out of phase from one another. The voltage control oscillator circuit 114 is conventional, and the phase signal generator 112 includes conventional circuitry for generating approximately 50 percent duty cycle wave forms and their complements. In the preferred embodiment the VCO circuit 114 operates at slightly higher than 240 Hertz during carrier frequency operation. This frequency accounts for inherent "slip" of the induction motor 102 and provides a frequency multiplication factor of four necessary for the phase signal generator 112 to provide the phase signals $\phi A$, $\phi B$ at the desired 60 Hertz frequency. For convenience of description, the slip of the motor will hereafter be assumed negligible.

In the preferred embodiment the circuitry for maintaining the carrier frequency and phase of the acoustic signal in the absence of selected data signals, in combination with the motor switching circuit 110, the phase signal generator 112, and the voltage controlled oscillator circuit 114, advantageously implements a phase locked loop circuit.

The phase and frequency maintaining circuitry includes a tachometer 120 coupled to the motor 102 for producing a series of pulses whose repetition rate is indicative of the frequency at which the motor 102 is driven. In the preferred embodiment the tachometer 120 is selected to generate six cycles per revolution of the motor. This ratio in combination with the design of the modulator 80, the design of the drive linkage 96, and the 60 Hz speed of the motor 102, results in the generation of an acoustic signal within the drilling mud having a 12 Hz carrier frequency and in the generation of a tachometer output signal $\omega_T$ having a 360 Hz frequency.

A tachometer signal conditioning circuit 122 is coupled to the output of the tachometer 120 for providing a relatively low frequency loop frequency signal, $\omega_L$, and a relatively high frequency motor frequency signal $\omega_M$. For example, the loop frequency signal $\omega_L$ is produced at a 24 Hz frequency and the motor frequency signal $\omega_L$ is produced at a 720 Hz frequency when the motor is operating at 60 Hz. The conditioning circuit 122 is conventionally implemented using zero crossing circuitry and frequency multiplying/dividing circuitry.

The phase locked loop circuitry further includes a phase detector circuit 124. The phase detector circuit 124 is responsive to the loop frequency signal $\omega_L$, and to a 24 Hertz loop reference frequency signal $\omega_{LF}$ to selectively generate a VCO control signal on a line 126 which is operatively coupled to the VCO circuit 114 via a loop switch 128. The phase detector 124 is conventional and may include a set/reset flip-flop (not shown) responsive to the signals $\omega_L$, $\omega_{LF}$ and a low pass filter (not shown) coupled to the output of the flip-flop. The output of the detector 124 generates the VCO control signal as a function of the difference per loop cycle between the $\omega_L$ and $\omega_{LF}$ signals to be indicative of the motor 102 deviating from the constant carrier frequency or phase. In response to the control signal on the line 126, the VCO circuit 114 changes the excitation frequency supplied to the motor 102 via the inverter 110 to return the motor to and maintain it in phase and frequency lock.

The above referred Sexton et al. patent, U.S. Pat. No. 3,870,063 shows and describes another phase locked loop circuit operating on similar principles.

The circuitry for changing the speed of the motor 102 to thereby change the phase of the acoustic signal in response to data from the sensors 100 is implemented digitally in the illustrated and preferred embodiment. The digital implementation effects a frequency and phase change in the acoustic signal rapidly yet in an extremely accurate manner. The size of the package for the motor control circuitry has been reduced over that of previously proposed analog systems due to the digital implementation, and reliability over wide environmental ranges is achieved. However, the invention is also suitably implemented in analog systems if so desired.

As will be described, the circuitry for changing the speed of the motor operates initially to decelerate the speed of the motor 102 and then to accelerate it for accumulating the total phase change of 180 degrees. Although an acceleration/deceleration sequence is operable, the deceleration/acceleration sequence results in the motor 102 operating in a higher torque range and thus in the modulating of the acoustic signal more predictably and in a shorter period of time.

The speed changing circuitry operates the switch 128 and a set of acceleration and deceleration switches 130, 132, which respectively control the voltage input to the VCO circuit 114. In the illustrated embodiment, the acceleration switch 130 has one terminal commonly connected to the input of the VCO circuit 114 and to one terminal of the loop switch 128. It has its other terminal commonly coupled to a ramp voltage producing network and to the deceleration switch 132 via a resistor R1. The ramp voltage need not be limited to a linearally changing voltage. For example it may change substantially exponentially with time. As illustrated an RC timing circuit comprising the series connection of a resistor R2 and capacitor C between a voltage $V_1$ and circuit ground produces an exponentially increasing voltage. Accordingly, when the loop switch 128 is open, the acceleration switch 130 is in the closed position and the deceleration switch is opened, the input to the VCO circuit 114 is a ramp voltage, effecting an output from the VCO circuit 114 which increases with time and thus effecting acceleration of the motor which is an increasing function with time. This assures that the phase change in the acoustic signal is accomplished as rapidly as possible.

The deceleration switch 132 has one terminal commonly connected to the resistor R1 and thus to the switch 130. It has its other terminal connected to circuit ground. When the acceleration switch 130 is closed and the deceleration switch 132 is in the closed position, the capacitor C, which had been discharged through the resistor R1 to circuit ground by closing of the switch 132, remains discharged. In the preferred embodiment upon closing of the switch 130, the discharged capacitor C produces a voltage level at the input of the VCO circuit 114 which causes the output of the VCO circuit 114 to step down to approximately 180 Hz from its otherwise constant carrier frequency producing output of approximately 240 Hz.

The speed changing circuitry includes a targeting phase accumulator 140, a motor frequency detector 142 and a control logic circuit 144. In response to input signals from the targeting phase accumulator 140 and from the motor frequency detector 142, the control logic circuit 144 generates a set of control signals, $\overline{X}$, X, and $\overline{Z}$ on a set of lines 145, 146, 147 to the switches 128, 130, 132 respectively. These signals are generated in a sequence, appropriately initiated by data from the sensors 100, which: (1) initially opens the loop switch 128 to take control away from the phase lock loop; (2) closes the acceleration switch 130 (the deceleration switch 132 already having been closed) to cause a low voltage level to be supplied to the VCO circuit 114 to thereby cause rapid deceleration of the motor 102, and thus change the frequency of the acoustic signal to approximately 9 Hz; (3) to open the deceleration switch 132 while leaving closed the acceleration switch 130 to begin acceleration of the speed of the motor 102 back toward the carrier frequency producing speed; and, (4) thereafter to open the acceleration switch 130 and to close the loop switch 128 to return control of the motor 102 back to the phase lock loop when the carrier frequency producing speed has been achieved by the motor 102.

Figure 4:
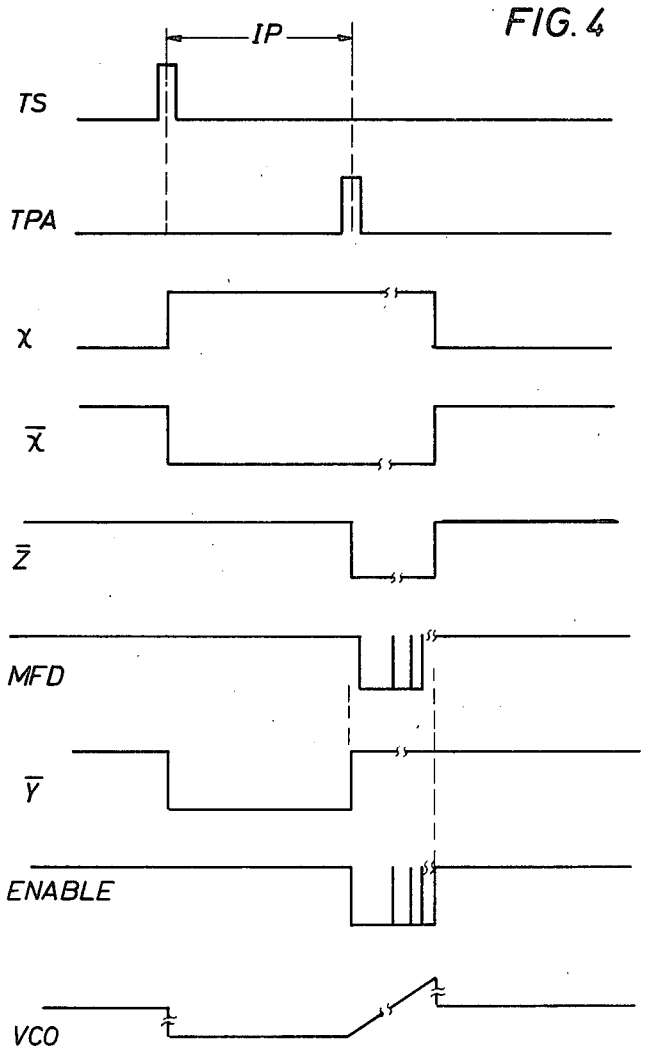
FIG. 4 is a set of exemplary waveforms illustrating operation of the downhole telemetering apparatus.

In more detail and referring to the waveforms depicted in FIG. 4, the targeting phase accumulator 140 generates a TPA control signal on the line 148 a period of time, referred to as the integrating period IP, corresponding to the accumulation of the predetermined amount of phase change, after a transition start (hereafter TS) timing signal has been generated on a line 149. At the beginning of one integrating period, IP, the logic control circuit 144 is generating the X, $\overline{X}$, and $\overline{Z}$ control signals to open the loop switch 128 and to close the acceleration switch 130 and to maintain closure of the deceleration switch 132, thereby causing deceleration of the motor 102.

In effect, the targeting phase accumulator 140 is a differential integrating circuit. That is, during the integrating period, the targeting phase accumulator 140 effectively is integrating the difference between a 720 Hertz motor reference frequency signal, ωMR, on a line 150 and the motor frequency signal, ωM, on a line 152. In the illustrated embodiment, the signals ωMR and ωM are integrated. The difference between these integrated signals produces an indication of the amount of phase which is being accumulated due to speed changes of the motor 102. When the difference between the integrated values of the signals on the lines 150, 152 reaches a predetermined value due to the deceleration of the motor speed, the targeting phase accumulator 140 generates the TPA signal on the line 146, causing the control logic circuit 144 to open the switch 132. This permits the beginning of the rapid acceleration of the speed of the motor back toward the carrier frequency producing speed.

As above indicated for the illustrated embodiment, the motor reference frequency signal $\omega_{MR}$ on the line 150 is a 720 Hz signal. This results in sixty cycles of the motor reference frequency signal being produced for each cycle of the 12 Hz carrier frequency. Accordingly, thirty cycles of the $\omega_{MR}$ signal correspond to 180 degrees of phase of the 12 Hz carrier.

Since a finite time is required to return the motor speed to the 60 Hz, carrier frequency producing speed, phase shift additional to that effected by the deceleration is accumulated during the return. With a typical load on the motor, it has been ascertained that approximately 65 degrees of carrier phase change is accrued in the process of returning the speed of the motor 102 back from the 45 Hz frequency to the carrier frequency producing speed of 60 Hz. Accordingly, it is necessary to accumulate 115 degrees of phase change in the targeting phase accumulator 140 prior to the generation of the TPA signal and thus of the beginning of the acceleration of the speed of the motor back towards 60 Hz. Since 30 cycles of the $\omega_{MR}$ signal correspond to 180 degrees of carrier phase shift, the targeting phase accumulator 140 needs to accumulate $$115/180 \times 30 = 19 \text{ cycles or counts} \qquad \text{EQN. 1}$$

as the difference between the integrated $\omega_M$ and integrated $\omega_{MR}$ signals. The calculation in EQN. 1 is conditioned upon the characteristic linear relationship between phase loss and phase gain of the acoustic signal as a function of the changing of the motor frequency signal $\omega_M$.

The amount of additional phase accumulated due to return of the motor speed varies with motor loading. However, because the phase and frequency maintaining circuitry operates with inputs at twice the carrier frequency of 12 Hz, it acts to pull the motor speed into lock at 180 degrees of phase change even when the phase changing circuitry results in a range of 91–269 degrees of phase change. However, as an outstanding feature of the invention, and as will be described subsequently, the targeted value of 115 degrees of phase change is updated and modified according to loading conditions on the motor 102. This updating allows the frequency changing circuitry to effect nearly the precise amount of phase change desired when it returns the speed of the motor back to substantially the carrier frequency producing speed, at which time it gives control back to the phase and frequency maintaining circuitry. This minimizes the time period required for the phase locked loop circuit to precisely establish the predetermined amount of phase change in the acoustic signal at the carrier frequency.

In the illustrated embodiment to provide the differential integration the targeting phase accumulator 140 includes a pair of digital accumulator circuits in the form of a motor frequency counter 154 and a tach reference frequency country 156. The motor frequency 154 is presettable to a value indicative of a desired amount of phase loss (i.e., the target value of 115 degrees) due to the deceleration of the motor during the integrating period. In the preferred embodiment the counter 154 is preset or updated after every encoding by a targeting compensation circuit 157 for adjusting the target valve according to loading conditions on the motor 102. For purposes of simplifying the description of the targeting phase accumulator, it will be assumed that the targeting compensation circuit 157 is maintaining the target valve of 115; i.e., no changes in the loading of the motor 102 are occurring.

The targeting phase accumulator 140 also includes a digital comparator 158. The digital comparator 158 is coupled to the outputs of the counters 154, 156 and determines when the tach reference frequency counter 156 has been incremented by a value of 19 more than the motor frequency counter 154. Upon this condition, the comparator 158 generates the TPA signal to the motor control logic circuit 144, indicating that the target value of 115 degrees of phase change has been accumulated.

Figure 3:
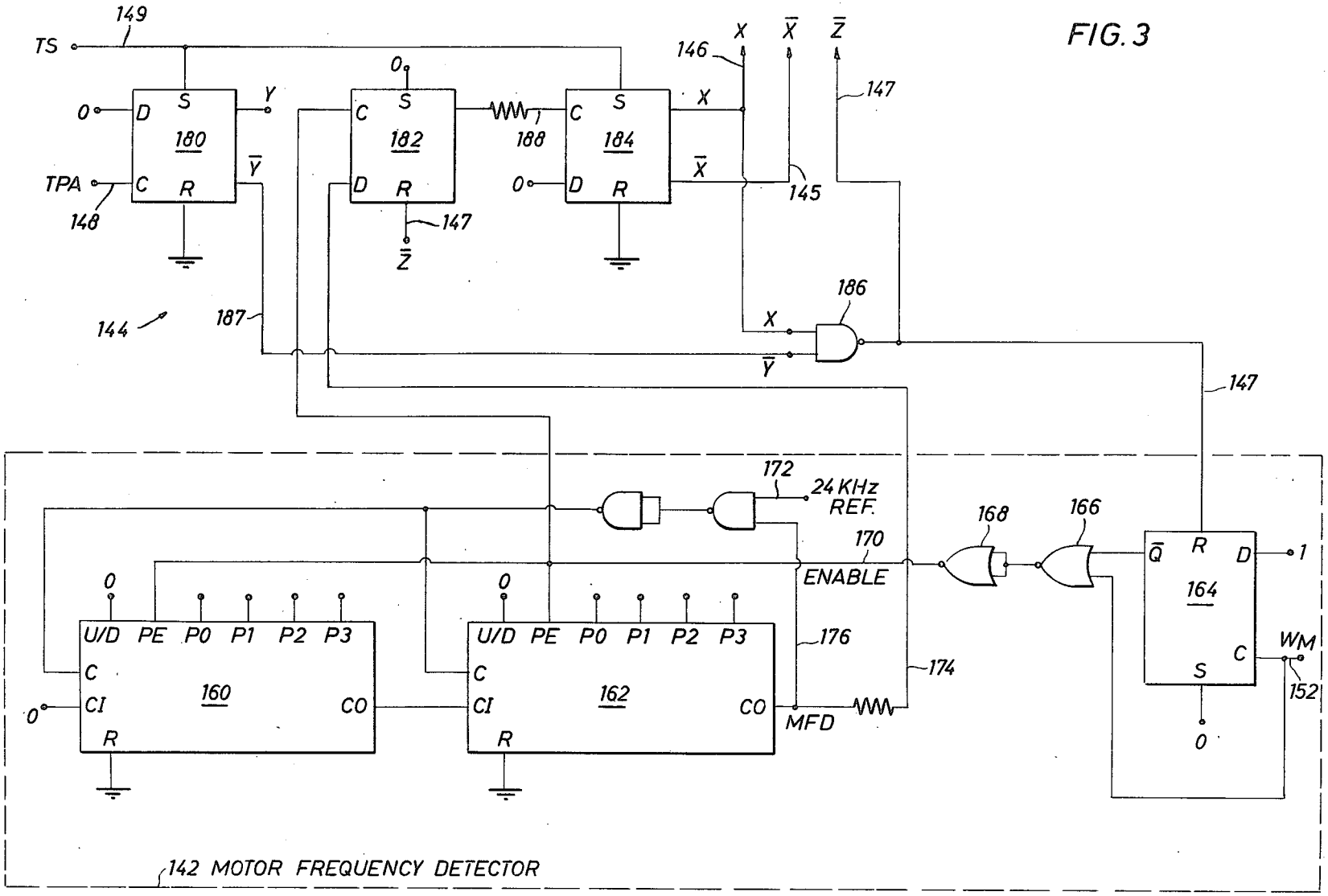
FIG. 3 is a circuit schematic of logic circuitry utilized within the downhole telemetering apparatus of FIG. 2.

The motor frequency detector 142 and the control logic circuit 144, as shown in detail in FIG. 3, effect acceleration of the speed of the motor 102 back to the 60 Hz carrier frequency producing speed. The detector 142 comprises a digital integrator which includes a pair of presettable counters 160, 162 which are coupled to the output of an R/S flip-flop 164. The flip-flop 164 has its clock input coupled to the line 152 for receiving the motor frequency signal $\omega_M$ and generating an ENABLE signal through a pair of gates 166, 168 to the counters 160, 162 via a line 170. The ENABLE signal on the line 170 is generated upon the absence of the $\overline{Z}$ control signal on the line 147 to the reset terminal of the flip-flop 164. The $\overline{Z}$ control signal on the line 147 is removed by the control logic circuit 144 upon generation of the TPA signal (at the end of the integration period IP) on the line 148 from the targeting phase accumulator 140.

Because the motor 102 has been decelerated to a speed less than 60 Hz at the time of the occurrence of the TPA signal, the period of the motor frequency signal $\omega_M$ is longer than normal. The purpose of the presettable counters 160, 162 is to determine when the period of the motor frequency signal $\omega_M$ is indicative that the speed of the motor has been accelerated back to 60 Hz after generation of the TPA signal. To this end, the counters 160, 162 have preset lines (not shown) which determine the number of counts the counters 160, 162 will achieve when the period of the $\omega_M$ signal is proper for 60 Hz operation. The counters 160, 162 are also responsive to a 24 KHz high frequency reference signal on a line 172 which provides a high frequency clocking signal to the counters for incrementing them. The counters 160, 162 are preset to the value which causes a MFD signal to be generated on a line 174 whenever the 24 KHz reference signal on the line 172 causes the number of counts accumulated by the counters 160, 162 to exceed the preset value. The period of the ENABLE signal on the line 170 is decreasing with time due to the acceleration of the motor. Eventually the MFD signal on the line 174 is not generated for a given period of the ENABLE signal. Upon this condition, the motor 102 is operating once again at the carrier frequency producing speed.

Operation of the motor frequency detector 142 is better understood when considering the control logic circuit 144 as shown in FIG. 3. The control logic circuit 144 includes three R/S flip-flops 180, 182, 184 and a NAND gate 186. The flip-flops 180, 184 respectively generate a $\overline{Y}$ signal on a line 187 and the X and $\overline{X}$ signals on the lines 146, 145. The gate 186 is coupled to the lines 146, 187 for generating the $\overline{Z}$ signal on the line 147 as a function of the X and $\overline{Y}$ signals.

The flip-flops 180, 184 are responsive to the TS timing signal on the line 149 and are set upon the occurrence of data of a predetermined logic state as sensed by the sensors 100. Setting of the flip-flop 184 causes a logic 1 and a logic 0 to be generated as the X and $\overline{X}$ signals, thereby closing and opening the acceleration and loop switches 130, 128 respectively. The flip-flop 180 generates a logic zero as the $\overline{Y}$ signal on the line 187 upon its being set by the TS signal. The $\overline{Y}$ signal is then coupled to the gate 186 for generating a logic one state of the $\overline{Z}$ signal. Upon the occurrence of the TPA signal at the end of the integration period IP, the TPA signal on the line 148 clocks the flip-flop 180, changing the $\overline{Y}$ signal to a logic one. During this interval, the $\overline{Z}$ signal has maintained closed the deceleration switch 132 and has disabled operations of the flip-flop 182 by way of the reset input.

Recapitulating, upon generation of the TS timing signal and thus at the beginning of the integration period IP, the X, $\overline{X}$, and $\overline{Z}$ signals have respectively closed the switch 130, opened the switch 128, and maintained closure of the switch 132, causing deceleration of the motor 102.

At the end of the integration period when the targeting phase accumulator 140 has indicated that the desired 115 degrees of phase has been accumulated, as indicated by the TPA signal on the line 148, the flip-flop 180 changes state. This results as a logic 0 is applied to its data input and the TPA signal is applied to its clock input. This change of state generates a logic 1 as the $\overline{Y}$ signal on the line 187, causing a logic 0 to be generated on the line 147 as the $\overline{Z}$ signal. This opens the deceleration switch 132, ending the deceleration phase of the motor speed change and beginning the acceleration phase.

Referring now additionally to the motor frequency detector 142, as is also illustrated in detail in FIG. 3, when the $\overline{Z}$ signal on the line 147 changes to a logic 0, the flip-flops 164 and 182 become unlatched. A logic 1 applied to the data input of the flip-flop 164 is then clocked thereinto by the motor frequency signal $\omega_M$, producing a logic zero at one input of the gate 166. Another input of the gate 166 receives the $\omega_M$ signal on the line 152. The gate 166, 168 thereby generate the ENABLE signal on the line 170 to the counters 160, 162 for presetting them at the beginning of every cycle of the $\omega_M$ signal. The counters then begin counting at a 24 kHz rate, as determined by the 24 kHz signal on a line 172.

At the end of the ENABLE signal, i.e., at the end of one cycle of the motor frequency signal $\omega_M$, if a carry has occurred out of the counter 162, i.e., if a logic 0 has been generated on the line 174 as the MFD signal, the flip-flop 182 remains in the reset state (having been placed into the reset state by the $\overline{Z}$ signal on the line 147 upon the occurrence of the X signal going to the logic zero state, indicating the end of the modulation). Only upon the conditions that a logic 1 is provided on the line 174 to the flip-flop 182 when a logic 1 ENABLE signal occurs will a clock signal be provided via a line 188 to the flip-flop 184. Unless a clock signal is provided via the line 188, the flip-flop 184 maintains the X and $\overline{X}$ signals in the logic 1, logic 0 states as respectively set by the TS timing signals.

When the counters 160, 162 indicate that the period of the ENABLE signal, i.e., the period of one cycle of the motor frequency signal $\omega_M$ has been reduced to a value corresponding to a motor frequency of 60 Hz, no carry out of the counter 162 will occur. The logic 1 needed to change the state of the flip-flop 182 upon the next occurring ENABLE signal is thereupon generated. This provides a clock signal to and changes the state of the flip-flop 184, which in turn changes the states of the X and $\overline{X}$ signals, thereby closing the loop switch 128 and opening the acceleration switch 130.

It is understood that, when viewing the MFD signal as depicted in FIG. 4 in connection with the above description, the value of the MFD signal is a logic 1 state during counting by the counters 160, 162. Because this time period is very small and the time scale of FIG. 4 is relatively large, these pulses appear as spikes. Also, the breaks in the MFD and ENABLE signals indicate that, when the motor 102 is back to full speed and the MFD signal remains in a logic 1 state due to no carry out from the counter 162, the ENABLE signal subsequently changes to a logic 1 state in which it remains until the next decoding stage.

For purposes of simplifying the description of the phase and frequency maintaining circuitry and of the carrier frequency maintaining circuitry, it has heretofore been assumed that the targeting compensation circuit 157 has been maintaining the target value of the targeting phase accumulator 140 at a constant 115 degrees of phase. This corresponds to no changing in the loading on the motor 102. During actual well drilling operations, however, there are loading changes on the motor 102. These loading changes are quasi-static in that they usually change only very slowly with time. The targeting compensation circuit 157 detects these changes in loading on the motor 102 and adjusts the preset of the targeting phase accumulator 140, i.e., the targeting value heretofore identified as 115 degrees, to cause the total phase shift provided by first the deceleration and then the acceleration of the motor during encoding to be the total desired amount. Because the compensation circuit operates continuously, no prior knowledge of the loading conditions on the motor 102 is necessary.

Figure 5:
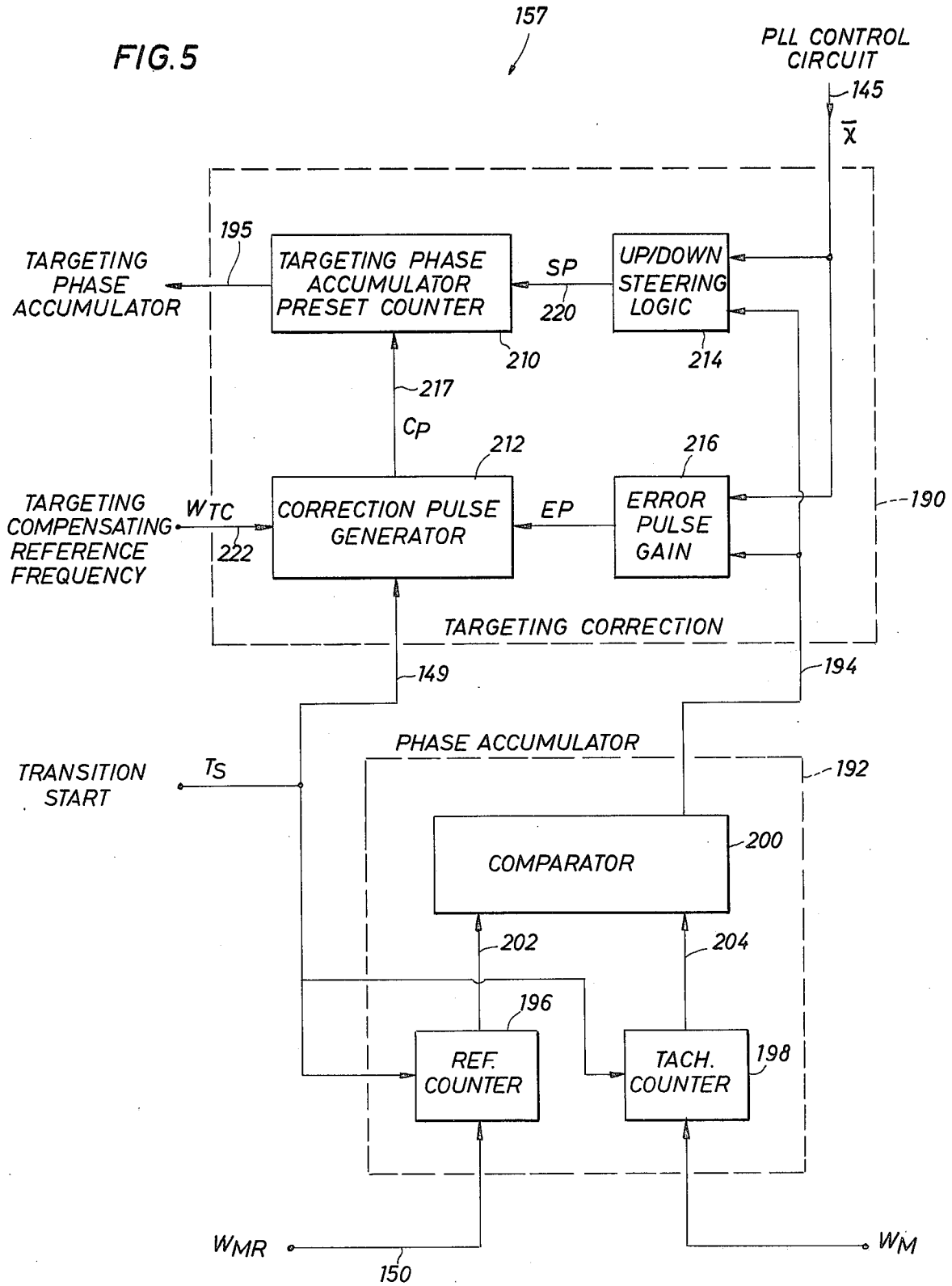
FIG. 5 is a functional block diagram depicting targeting compensation circuitry utilized in the apparatus of FIG. 2.

Referring now to FIG. 5, the targeting compensation circuit 157 includes a targeting correction circuit 190 and an end of transition (EOT) phase accumulator 192. The EOT phase accumulator 192 computes the total amount of phase accumulated during each encoding, i.e., that which is caused by the deceleration and acceleration of the motor 102, and generates an EOT signal on a line 194 to the targeting correction circuit 190 when the desired total phase shift for the encoding has been accumulated. In the illustrated and preferred embodiment, this phase shift is 180 degrees for binary encoded data. The targeting correction circuit 190 is responsive to the EOT signal and adjusts the preset value of the targeting phase accumulator 140 via a line 195 according to whether more or less than 180 degrees of phase has been accumulated by the accumulator 192.

The EOT phase accumulator 192 is in effect another differential integrator circuit similar to that implemented for the targeting phase accumulator 140. The accumulator 192 generates the EOT signal when the difference between the integrated motor reference frequency signal $\omega_{MR}$ and the motor frequency signal $\omega_M$ exceeds a predetermined value corresponding to the total desired amount of phase change. In the illustrated and preferred embodiment, the differential integrating circuit includes a reference counter 196, a tachometer counter 198, and a comparator 200.

The reference counter 196 is responsive to the motor reference frequency signal $\omega_{MR}$ on the line 150 and to the TS timing signal on the line 149 for generating an integrated motor reference frequency signal on a line 202 to the comparator 200. The integrated motor reference frequency signal is indicative of the value of the carrier frequency integrated over the time period beginning upon the occurrence of the TS signal, i.e., upon the occurrence of selected data from the encoding circuitry 101. The TS timing signal resets the counter 196 at the beginning of each IP integration period.

The tachometer counter 198 is responsive to the motor frequency signal $\omega_M$ and to the TS timing signal for producing an integrated motor frequency signal on a line 204. The integrated motor frequency signal $\omega_M$ is indicative of the value of the instantaneous motor speed integrated over the IP integration period beginning upon the occurrence of each TS timing signal. Similarly to the reference counter 196, the tachometer counter 198 is reset by the TS signal. Although not shown, the tachometer counter 198 is a programmable counter and has programming inputs set to a value corresponding to a 180 degrees phase shift. According to the described system, this value is a count of thirty. Presetting of the tachometer counter 198 allows a difference of 180 degrees of phase to be indicated when the integrated signals on the lines 202, 204 achieve the same digital value.

The comparator 200 is coupled to the lines 202, 204 for detecting when the digital values of the integrated signals from the counters 196, 198 become equal. This indicates that 180 degrees of phase has been accumulated in the acoustic signal due to operation of the frequency changing circuitry. A latch circuit (not shown) is coupled to the output of the comparator 200. Upon the condition that the digital values become equal, the comparator 200 sets the latch circuit for generating the EOT signal on the line 194. The latch circuit is reset by the TS timing signal.

The targeting correction circuit 190 includes a preset counter 210, a correction pulse generator 212, up/down steering logic 214, and an error pulse generator 216. The targeting correction circuit 190 is responsive to the EOT signal on the line 194 and to the $\overline{X}$ signal on the line 145 for generating a signal on the line 195 which updates the preset value of the motor frequency counter 154 in the targeting phase accumulator 140 according to whether more of less than 180 degrees of phase shift has been accumulated during the encoding. Accordingly, the motor loading compensation for one encoding is based on a previous encoding; or, stated in other terms, the correction for motor loading during a given encoding is compensation for the next occurring encoding.

The preset counter 210 is a conventional up/down counter implemented using a pair of serially connected, four bit, up/down counters. The preset counter 210 receives a clock pulse on a line 217 from the correction pulse generator 212 whenever the total accumulated phase shift during an encoding differs by more than a predetermined value from the targeted value of 180 degrees. In the illustrated embodiment, because each count of the motor frequency counter 154 corresponds to 6 degrees of phase shift accumulated, each CP pulse generated to the preset counter 210 either increments or decrements the target value of the motor frequency counter 154 by 6 degrees. Whether the counter 210 increases or decreases in value depends upon a steering pulse SP generated on a line 220 from the up/down steering logic 214.

The correction pulse generator 212 includes a pair of serially connected four bit binary counters which are reset by the TS timing signal. The counters are responsive to a targeting compensation reference frequency signal $\omega_{TC}$ on a line 222 and to an error pulse, EP from the error pulse generator 216. When the error pulse EP is of a sufficient duration according to the frequency of the $\omega_{TC}$ signal, a pulse is generated from the output of the counters to provide the CP clock pulse to the preset counter 210. The CP pulse is also coupled to the counters for resetting them. Accordingly, by choosing any of various frequencies for the $\omega_{TC}$ signal, the amount of overshoot or undershoot of the accumulated phase shift which triggers adjustment of the targeting value of the preset counter 210 is adjustable. In the preferred embodiment a frequency of approximately 380 Hz is used for the targeting compensation reference frequency signal $\omega_{TC}$.

The error pulse generator 216 is responsive the the $\overline{X}$ signal on the line 145 and to the EOT signal on the line 194. In the preferred embodiment the generator 216 is an EXCLUSIVE-OR circuit for producing the EP signal having a pulse width indicative of the time difference between the returning of control to the phase and frequency and maintaining circuitry (as indicated by the change of state of the $\overline{X}$ signal) and achieving of the 180 degrees total phase (as indicated by the EOT signal). The time difference translates into a specific number of degrees of phase shift which either exceeds or is less than the targeted value of 180 degrees.

The up/down steering logic 214 is responsive to the EOT signal on the line 194 and to the $\overline{X}$ signal on the line 145 for generating the SP signal on the line 220. The up/down steering logic in the preferred embodiment is an RS flip-flop having its clock terminal coupled to receive the $\overline{X}$ signal, having a logic 1 impressed on its data input terminal and which is reset by the EOT signal. Accordingly, the SP signal on the line 220 is generated as either a logic 1 or logic 0 depending on which of the $\overline{X}$ or EOT signals first occurred, thereby indicating whether control has been returned to the phase and frequency maintaining circuit, i.e., the phase lock loop, before or after 180 degrees of phase has been accumulated.

Referring again to FIG. 2 the TS timing signal is produced is a conventional way by a transition start circuit 230. The transition start circuit 230 generates a pulse as the TS timing signal upon the occurrence of data of a predetermined logic state as sensed by the sensors 100 and encoded by the encoding circuitry 101. In the illustrated and preferred embodiment, the encoding circuitry 101 encodes the data from the sensors 100 into binary and the transition start circuit 230 detects whenever a logic 1 signal has been encoded by the encoding circuit 101 and generates the TS timing signal accordingly.

The transition start circuit 230 is suitably described in the above-referenced Sexton et al. patent, U.S. Pat. No. 3,820,063, which previously has been incorporated by reference.

Although a preferred embodiment of the invention has been described in a substantial amount of detail, it is understood that the specificity has been for example only. Numerous changes and modifications to the circuits and apparatus will be apparent without deparing from the spirit and scope of the invention.

What is claimed is:

1. In a measuring-while-drilling system including an acoustic generator having a driven moveable member disposed for imparting to well fluid an acoustic signal having an intermittently constant frequency and including controlled drive means for changing the rate of movement of the member to effect a change of phase of the acoustic signal thereby to provide modulated data states to the acoustic signal, an improved control circuit for the drive means comprising:

(a) first means for changing the rate of movement of the moveable member from the substantially constant frequency to a different phase accumulating frequency;

(b) means, coupled to said changing means and including a presettable accumulator circuit, for generating a control signal when the amount of phase change reaches a prescribed value;

(c) second means for returning the rate of movement of the moveable member substantially to the constant frequency upon the occurrence of the control signal thereby accumulating phase change additional to said prescribed value for effecting a total amount of phase change in said acoustic signal; and (d) means, including a phase accumulator for indicating said total amount of phase change, for adjusting said prescribed value in response to said total amount of phase change.

2. The control circuit according to claim 1 wherein said phase accumulator is coupled to be responsive to the rate of movement of said member and wherein said means for adjusting generates a correction signal to said control signal generating means for adjusting the presetting of said accumulator circuit when said total phase change differs from a desired amount by at least a predetermined value.

3. The control circuit according to claim 1 and including a motor for driving the moveable member and wherein the first means initially decelerates the speed of the motor to the different value and then maintains the speed at said different value until generation of said control signal.

4. The control circuit according to claim 1 and further including phase and frequency maintaining means for maintaining the frequency of the acoustic signal at the carrier frequency after said second means has returned it to substantially the carrier frequency.

5. In a measuring-while-drilling system including an acoustic generator having a moveable member driven at speeds for imparting to well fluid an acoustic signal having modulated phase states representative of data derived from measured downhole conditions, and further including means for driving the member at a substantially constant rate of operation to thereby effect a substantially constant carrier frequency in the acoustic signal and for temporarily changing the rate of movement of the member to effect targeted values of phase changes in the carrier frequency according to the data, wherein the rate of the member is temporarily changed from the constant rate to a first value until a prescribed portion of the targeted value of phase change is accumulated, as indicated by an internally generated control signal, and is then returned to the substantially constant rate in response to the control signal, the improvement wherein the driving means includes a control circuit having feedback compensation comprising:

a. differential integrating circuit means for generating the control signal when a target value is exceeded by the difference between (1) an integrated carrier frequency signal representing the value of the carrier frequency integrated over a time period beginning substantially upon the occurrence of one data signal and (2) an integrated drive frequency signal representative of the integral of the instantaneous rate of movement of the member integrated over said time period, wherein said differential integrating circuit means includes a presettable accumulator circuit responsive to one of said integrating signals and having programming inputs for receiving a targeting compensation signal which sets the state of the counter to thereby establish said predetermined value, and b. targeting compensation means coupled to said driving means for generating said targeting compensation signal in response to the rate of operation of said drive means.

6. The measuring-while-drilling system according to claim 5 where the targeting compensation means includes:

a. means for generating a first signal for presetting said accumulator circuit to an estimated value corresponding generally to said prescribed portion and b. means for generating a correction signal for adjusting said estimated value as a function of the amount of phase change provided to said acoustic signal during a previously occurring one of said temporary speed changes.

7. The measuring-while-drilling system according to claim 6 wherein the correction signal generating means comprises a targeting accumulator circuit for providing said correction signal in response to the difference between said integrated drive frequency signal and said integrated carrier frequency signal upon a preselected condition of said acoustic signal.

8. The measuring-while-drilling system according to claim 7 wherein the driving means includes an acoustic generator drive motor operable at a carrier frequency providing speed and wherein said condition is the return of the speed of said motor from the first value to approximately said carrier frequency producing speed.

9. The measuring-while-drilling system according to claim 5 wherein the rate of the member is changed in a first direction until said first value of rate is achieved and wherein the control circuit further includes a. means for maintaining movement of the member at said first rate value until said portion of the predetermined phase change is accumulated in response to said control signal and b. means for returning the rate of the movement of the member in the opposite direction towards said substantially constant rate in response to said control signal.

10. The measuring-while-drilling system according to claim 5 wherein the control circuit is responsive to an intermittent sequence of said one data signals and wherein said targeting compensation means generates said targeting compensation signal for one data signal in response to the amount of phase change accumulated in response to the occurrence of one of the previous one data signals.

11. The measuring-while-drilling system according to claim 5 wherein the control circuit further includes means responsive to said control signal for maintaining the rate of movement of the member at said first value until said prescribed portion of the phase change is accumulated.

12. The measuring-while-drilling system according to claim 5 wherein the control circuit further includes means responsive to the control signal for changing the rate of movement of the member back to said substantially constant rate from said first value upon the accumulation of said prescribed portion of the phase change.

13. The measuring-while-drilling system according to claim 5 wherein the presettable accumulator includes a programmable counter responsive to the targeting compensation signal.

14. A measuring-while-drilling system disposed within a well for imparting to well fluid an acoustic signal having modulated phase states representative of data derived from measured downhole conditions comprising:

a. an acoustic generator disposed within the flow of the well fluid for interrupting the flow of the fluid at a controlled rate;

b. a motor coupled for driving the acoustic generator to effect the fluid interruption; and c. a motor control circuit having feedback compensation for driving the motor at a substantially constant speed to thereby effect a substantially constant carrier frequency in the acoustic signal and for temporarily changing the speed of the motor to effect a predetermined phase change in the acoustic signal according to the downhole derived data, wherein the speed of the motor is temporarily changed from the carrier frequency producing speed to a different value until a prescribed portion of the predetermined phase change is accumulated and is then returned to the substantially constant speed, and wherein the control circuit further includes i. a differential integrating circuit for generating a control signal indicative of the accumulation of said prescribed portion when a predetermined value is exceeded by the difference between (1) an integrated carrier frequency signal representing the value of the constant carrier frequency integrated over a time period beginning substantially upon the occurrence of one data signal and (2) an integrated drive frequency signal representative of the integral of the instantaneous speed of the motor integrated over said time period, said differential integrating circuit including a presettable counter having programming inputs for receiving a targeting compensation signal which sets the state of the counter to thereby establish said predetermined value, and ii. targeting compensation means coupled to the motor for generating the targeting compensation signal in response to motor speed to thereby compensate the value of the prescribed portion for changing loading conditions on the motor.

15. The measuring-while-drilling system according to claim 14 wherein the targeting compensation means includes:

a. means for generating a first signal for presetting said counter to an estimated value corresponding generally to said prescribed portion, and b. means for generating a correction signal for adjusting said estimated value as a function of the amount of phase change provided to said acoustic signals during a previously occuring one of said temporary changes.

16. The measuring-while-drilling system according to claim 15 wherein the targeting compensation means further includes a targeting accumulator circuit for providing said correction signal in response to the difference between said integrated drive frequency and said integrated carrier frequency signals when the speed of the motor returns from the different value to approximately the carrier frequency producing speed.

17. The measuring-while-drilling system according to claim 16 wherein the speed of the motor is changed in a first direction until said different valve is reached and wherein the control circuit further includes a. means for maintaining the speed at said different value until said portion of the predetermined phase change is accumulated in response to the control signal, and b. means for returning the speed of the motor in the opposite direction toward said carrier frequency producing speed in response to said control signal.

18. A well measuring-while-drilling system for measuring downhole conditions and imparting a modulated acoustic signal representative thereof to drilling fluid within the well and which includes measuring apparatus adapted to be connected to a drill string and disposed in the well, the measuring apparatus inluding one or more sensors for sensing the downhole conditions and generating modulated sensor signals representative thereof, and including an acoustic generator responsive to the sensor signals for imparting to the drilling fluid an acoustic signal representative of one or more of the downhole conditions; wherein said acoustic generator comprises;

(a) a transmitter having a moveable member disposed for selectively interrupting the downward passage of the drilling fluid to thereby generate the encoded acoustic signals, (b) a motor for moveably driving said member, (c) a control circuit coupled to the sensor and to the motor for controlling energization thereof in response to the sensor signals, thereby to effect periodic interruption of the drilling fluid by the moveable member, the control circuit including a phase and frequency maintaining circuit operative to drive the motor at a substantially constant speed in the absence of a sensor signal of a predetermined value to thereby provide the acoustic signal to have a substantially constant carrier frequency and a first phase value, and a modulation control circuit operative in response to said predetermined value of said sensor signal to momentarily change the speed of the motor away from said constant speed and return it to said constant speed in response to a control signal to thereby provide the acoustic signal to have a second phase value relative to said first value, said modulation control circuit including first circuit means for integrating a carrier frequency signal representative of the constant carrier frequency; second circuit means for integrating a motor frequency signal representative of the substantially instantaneous speed of the motor; third circuit means, including a presettable accumulator circuit, for generating said control signal when the difference between the values of the integrated carrier and drive frequency signals reaches a predetermined value, thereby representative of the difference between said first and second phase values reaching a predetermined value during said momentary change in frequency; and fourth circuit means coupled to said motor for providing a targeting compensation signal to said presettable accumulator circuit for thereby establishing said predetermined value as a function of the speed of the motor.

19. The measuring-while-drilling system according to claim 18 where the fourth circuit means includes:

a. means for generating a first signal for presetting said accumulator circuit to an estimated value corresponding generally to said prescribed portion and b. means for generating a correction signal for adjusting said estimated value as a function of the amount of phase change provided to said acoustic signal during a previously occurring one of said temporary speed changes.

20. The measuring-while-drilling system according to claim 18 wherein said forth circuit means comprises a targeting accumulator circuit for providing said correction signal in response to the difference between said integrated motor frequency signal and said integrated carrier frequency signal when the frequency of the acoustic signal has returned substantially to the drive frequency.

21. In a measuring-while-drilling system including an acoustic generator having a driven moveable member disposed for imparting to well fluid an acoustic signal having an intermittently constant frequency, the method of momentarily changing the rate of movement of the member to effect a desired change of phase of the acoustic signal thereby to provide modulated data states to the acoustic signal, comprising the steps of:

(a) changing the rate of movement of the moveable member from the substantially constant frequency to a different, phase accumulating frequency thereby effecting a phase change;

(b) generating an accumulator signal representative of the amount of phase change accumulated due to said step of changing;

(c) generating a control signal in response to said accumulator signal when the amount of phase change reaches a prescribed value;

(d) returning the rate of movement of the moveable member to the constant frequency upon the occurence of the control signal; and (e) adjusting said prescribed value in response to said accumulator signal and thus the amount of phase change accumulated during said step of returning to thereby more precisely obtain said desired change of phase.

22. The method of measuring-while-drilling according to claim 21 wherein the modulated data states are provided in response to intermittently occurring data and wherein said step of adjusting includes the step of adjusting the prescribed value during the providing of one encoded data state in response to the phase change accumulated during the providing of the previous encoded data state.

23. The measuring-while-drilling method according to claim 21 wherein the moveable member is driven by a motor and wherein the step of changing the rate includes the steps of (a) initially decelerating the speed of the motor to the different value and (b) maintaining the speed at said different value until generation of said control signal.

24. The measuring-while-drilling method according to claim 21 wherein the moveable member is driven by a motor and wherein the step of returning includes the step of accelerating the speed of the motor back to the constant frequency producing speed in response to said control signal.

25. In a measuring-while-drilling system which includes a motor for driving an acoustic generator at predetermined speeds for imparting to well fluid an acoustic signal having phase states representative of data derived from measured downhole conditions and which further includes a motor speed control circuit for driving the motor at a first substantially constant speed to effect a carrier frequency for the acoustic signal and which momentarily changes the speed of the motor to thereby change the phase of the acoustic signal upon the occurrence of data, thereby to provide the acoustic signal with encoded states, the method comprising the steps of:

(a) generating a signal representative of the carrier frequency;

(b) generating a signal representative of the substantially instantaneous speed of the acoustic generator;

(c) changing the speed of the motor to a different value upon the occurrence of data;

(d) integrating the carrier frequency signal and the instantaneous speed signal over a time period beginning substantially upon the occurrence of said data;

(e) generating a control signal when the difference between said integrated signals reaches a predetermined value;

(f) returning the speed of the motor to substantially the carrier frequency producing speed in response to said control signal; and (g) changing said predetermined value in response to the amount of phase change accumulated during steps (a)–(f) in encoding the acoustic signal for previously occurring data.

26. The measuring-while-drilling method according to claim 25 wherein the step of changing the speed includes the step of maintaining the speed at the different value until generation of said control signal.

27. The measuring-while-drilling method according to claim 25 wherein said step of changing said predetermined value comprises the step of changing the predetermined value in response to the difference between said integrated speed signal and said integrated carrier frequency signal upon the condition that the speed of the motor has been returned to substantially the carrier frequency producing speed after generation of said control signal.

28. The measuring-while-drilling method according to claim 25 wherein said steps of generating the carrier frequency signal and the instantaneous speed signal comprises the steps of generating said signals digitally.

29. The measuring-while-drilling method according to claim 25 and including the step of generating an accumulator signal representative of the amount of phase change accumulated due to said step of changing the rate.

30. The measuring-while-drilling method according to claim 29 wherein said step of generating the accumulator signal includes generating said signal to be indicative of the accumulated phase change only until a desired total amount of phase change is achieved.

31. In a measuring-while-drilling system including an acoustic generator having a driven moveable member disposed for imparting to well fluid an acoustic signal having an intermittently constant frequency, the method of momentarily changing the rate of movement of the member to effect a desired change of phase of the acoustic signal thereby to provide modulated data states to the acoustic signal, comprising the steps of:

(a) changing the rate of movement of the moveable member from the substantially constant frequency to a different, phase accumulating frequency thereby effecting a phase change;

(b) generating a control signal when the amount of phase change reaches a prescribed value;

(c) returning the rate of movement of the moveable member to the constant frequency upon the occurrence of the control signal;

(d) generating an accumulator signal representative of the amount of phase change accumulated due to said steps of changing and returning; and (e) adjusting said prescribed value in response to said accumulator signal and thus to the amount of accumulated phase change to thereby more precisely obtain said desired change of phase.

32. A method of measuring-while-drilling for momentarily changing the speed of a motor-driven acoustic signal generator from a normally constant rate providing a carrier frequency signal to effect a selected phase change for modulating said carrier signal comprising the steps of: (a) changing the generator speed away from the normal rate to accumulate a portion of the selected phase change, and (b) upon generation of a control signal returning the generator speed to the normal rate to thereby accumulate substantially the remainder of said selected phase change; and characterized by:

generating said control signal when the phase change accumulated in one of steps (a) and (b) reaches a prescribed value; and adjusting said prescribed value in response to the phase change accumulated during the other of steps (a) and (b) of a preceding modulation.

33. In a measuring-while-drilling system for use downhole in a borehole, a method using a modulator for encoding a data signal representative of downhole drilling characteristics comprising the steps of:

(a) controllably operating the modulator to modulate the data signal in a selected manner to thereby generate a modulated data signal having a sequence of encoded data, the sequence of encoded data being defined by a sequence of modulations said selected manner being defined in an attempt to achieve desired modulation characteristics; and (b) during a given modulation, altering said selected manner of operation in response to a previously occurring modulation, thereby more nearly achieving said desired modulation characteristics.

34. In a measuring-while-drilling system for use downhole in a borehole, a method using a modulator for encoding a data signal representative of downhole drilling characteristics comprising the steps of:

(a) controllably operating the modulator to modulate the data signal in a selected manner in response to a compensation control signal to thereby generate a modulated data signal having a sequence of encoded data, the sequence of encoded data being defined by a sequence of modulations, said selected manner being defined in an attempt to achieve desired modulation characteristics; and (b) during a given modulation, adjustably generating said compensation control signal in response to a previously occuring modulation for altering the selected manner of operation of the modulator during the given modulation to more nearly achieve said desired modulation characteristics.

35. A measuring-while-drilling system for use downhole in a borehole, comprising:

(a) a modulator responsive to a data signal representing downhole drilling characteristics for providing a modulated signal having encoded states of data representative of the downhole drilling characteristics;

(b) means responsive to a compensation control signal for operating the modulator to provide said encoded states of data in a selected manner to thereby define a series of modulations, said selected manner being defined in an attempt to achieve desired modulation characteristics; and (c) compensating means responsive to a previously occuring modulation for generating said compensation control signal during a given modulation to thereby alter the selected manner of operation of the modulator during the given modulation, whereby said desired modulation characteristics are more nearly achieved during modulation subsequent to said previous modulation.

36. A measuring-while-drilling system comprising:

(a) a modulator adapted to be disposed in a flow of drilling fluid for imparting encoded states of data to the drilling fluid;

(b) means responsive to a compensation control signal for operating the modulator in a selected manner to thereby define a modulation, said selected manner defined in an attempt to achieve desired modulation characteristics; and (c) compensating means responsive to a previously occurring modulation for generating said compensation control signal during a given modulation to thereby alter the selected manner of operation of the modulator during the given modulation, whereby said desired modulation characteristics are more nearly achieved during modulation subsequent to said previous modulation.

37. A measuring-while-drilling system comprising:

(a) a modulator, including means for operating the modulator at more than one rate, adapted to be disposed in a flow of drilling fluid for imparting encoded states of data to the drilling fluid;

(b) means responsive to a compensation control signal for changing the rate of the modulator between selected rate values to thereby define at least part of a modulation; and (c) compensating means responsive to said changing of the modulator rate during a previously occurring modulation for generating said compensation control signal during a given modulation to thereby alter one of said selected rate values during the given modulation.

38. A measuring-while-drilling system comprising:

(a) a modulator adapted to be disposed in a flow of drilling fluid for imparting encoded states of data to the drilling fluid;

(b) means responsive to a compensation control signal for changing the modulator rate between first and second rates to thereby accumulate a value of phase change and define at least part of a modulation; and (c) compensating means responsive to said value of phase change accumulated during a previously occurring modulation for generating said compensation control signal during a given modulation to thereby change the amount of the phase change accumulated during the given modulation when the rate of the modulator is changed between substantially said first and second rates.

39. A measuring-while-drilling system comprising:

(a) a modulator, including means for operating the modulator at a normal rate, adapted to be disposed in a flow of drilling fluid for imparting encoded states of data to the drilling fluid;

(b) means responsive to a compensation control signal for changing the modulator rate away from the normal rate and returning it to the normal rate, thereby to accumulate to value of phase change and define at least part of a modulation; and (c) compensating means responsive to the value of phase change accumulated during a previously occurring modulation for generating said compensation control signal during a given modulation to thereby change the amount of the phase change accumulated during the given modulation.

* * * * *